United States Patent [19]

Ruger et al.

[11] Patent Number: 4,569,145

[45] Date of Patent: Feb. 11, 1986

[54] INACTIVATING SELECTOR ARRANGEMENT FOR BOLT ACTION FIREARMS

[75] Inventors: William B. Ruger, Croydon, N.H.; Roy L. Melcher, Stratford, Conn.

[73] Assignee: Sturm, Ruger & Company, Inc., South Port, Conn.

[21] Appl. No.: 691,788

[22] Filed: Jan. 16, 1985

Related U.S. Application Data

[63] Continuation of Ser. No. 555,969, Nov. 29, 1983, abandoned, which is a continuation-in-part of Ser. No. 490,502, May 2, 1983, abandoned.

[51] Int. Cl.[4] ..... F41C 11/06; F41C 17/02; F41C 17/04

[52] U.S. Cl. ..... 42/16; 42/70 R; 42/70 E; 42/70 F

[58] Field of Search ..... 42/16, 70 R, 70 C, 70 D, 42/70 E, 70 F

[56] References Cited

U.S. PATENT DOCUMENTS

| | | | |
|---|---|---|---|
| 1,318,423 | 10/1919 | Williams | 42/16 |
| 1,322,514 | 11/1919 | Bader | 42/16 |
| 2,607,148 | 8/1952 | Simpson | 42/70 E |
| 2,824,402 | 2/1958 | Fischer | 42/16 |
| 2,869,269 | 1/1959 | Couture | 42/70 E |
| 4,445,292 | 5/1984 | Martin | 42/70 R |

*Primary Examiner*—Charles T. Jordan
*Assistant Examiner*—Ted L. Parr
*Attorney, Agent, or Firm*—Pennie & Edmonds

[57] ABSTRACT

An inactivating selector arrangement for a bolt action firearm for inactivating the sear and trigger and for inactivating the bolt. The multiposition selector is rotatable to a first position to restrain the sear-trigger; to a second position to restrain both sear-trigger and bolt and to a third position in which neither sear-trigger nor bolt is restrained.

7 Claims, 18 Drawing Figures

INACTIVATING SELECTOR ARRANGEMENT FOR BOLT ACTION FIREARMS

RELATIONSHIP WITH PRIOR APPLICATION

This is a continuation of application Ser. No. 555,969 filed Nov. 29, 1983, now abandoned, which is a continuation-in-part of U.S. application Ser. No. 490,502, entitled "Inactivating Selector Arrangement For Bolt Action Firearms" filed May 2, 1983, now abandoned.

BACKGROUND OF THE INVENTION

1. Field of the Invention

This invention relates to bolt action rifles, and in particular to an inactivating selector arrangement for selectively restraining movement of the sear, trigger or cocking piece or all three.

2. Prior Art

The major components of a conventional bolt action firearm comprise the barrel, a receiver secured to the rear of the barrel, a cylindrical breech bolt mounted in the receiver in axial alignment with the barrel, a firing mechanism including the trigger mounted on the receiver below the bolt, and the stock. The cylindrical breech bolt is rotatable about its longitudinal axis from its locked firing position to its unlocked extracting and loading position, the bolt being longitudinally slidable within the receiver when it is in its unlocked position.

When the bolt is rotated from its locked to its unlocked position and then is moved rearwardly, the spent cartridge is extracted from the chamber of the barrel and is ejected. When the bolt is moved forwardly from its rearwardmost position a fresh cartridge is inserted into the chamber of the barrel. When the bolt reaches its forewardmost position it is rotated about its longitudinal axis to lock the bolt and cock the firing mechanism.

Associated with the breech bolt is a spring powered cocking piece which is held by a sear in the ready-to-fire position. Operation of the trigger moves the sear to release the cocking piece.

Many arrangements for preventing movement of the cocking piece, the sear or trigger, to in turn, prevent or restrain movement of the cocking piece toward the cartridge have been proposed but none have provided the features and advantages of the present invention.

SUMMARY OF THE INVENTION

Broadly, the present invention comprises a selector arrangement for restraining movement of the trigger or bolt handle or both. The arrangement includes a rotatable selector carrying in fixed relation a selector body portion and a selector handle projection, a trigger and sear blocker associated with the selector body portion, and a bolt handle plunger movable by the selector projection whereby rotatable movement of the selector to first position causes trigger and sear blocker to block movement of the trigger and sear and movement of the selector to a second position causes the selector to continue to hold the trigger and sear in its blocking mode while the selector in addition moves a bolt plunger to restrain movement of the bolt handle. In a third position the selector arrangement is passive.

It is a feature of the inactivating selector arrangement that selector projection is moved to a position in a recess in the cocking piece as the selector is placed in the second position. In this position, the selector projection will prevent any substantial forward movement of the cocking piece.

DESCRIPTION OF THE PREFERRED EMBODIMENT

Figure 1:
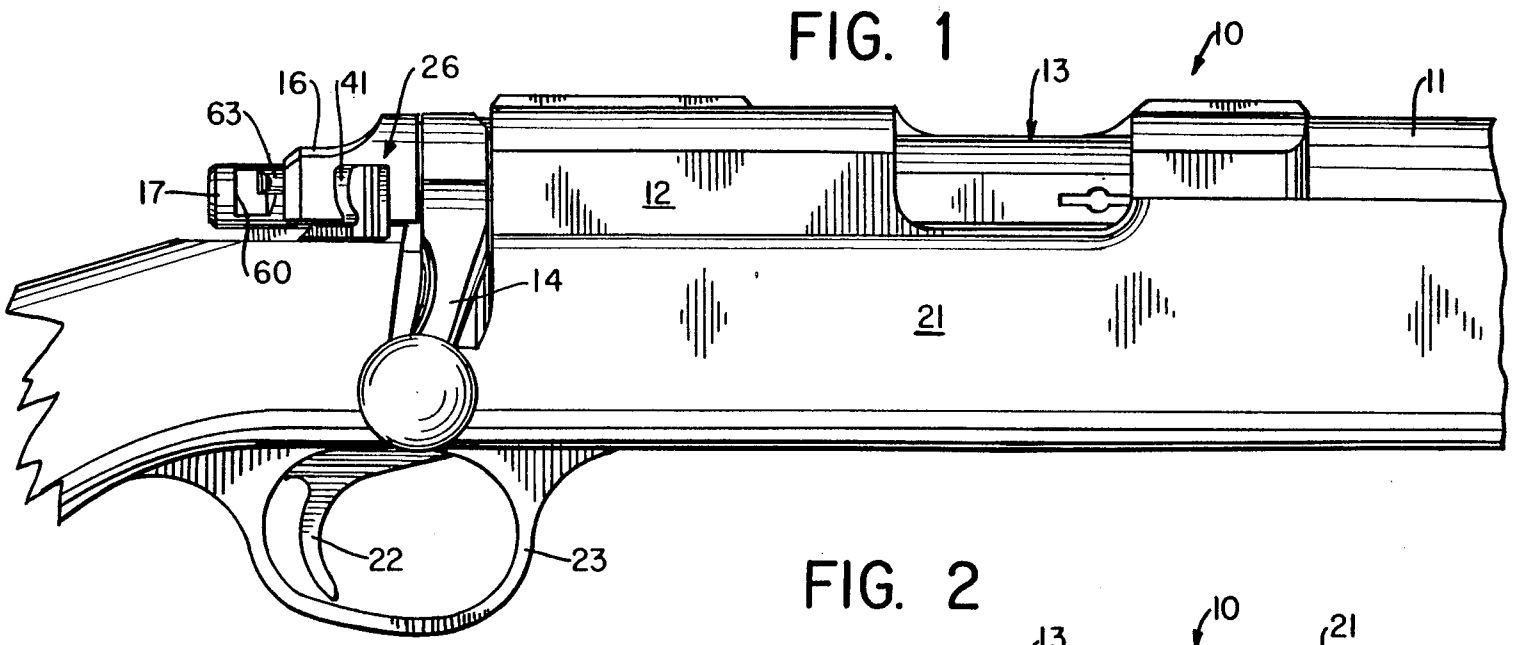
FIG. 1 is a partial side elevational view of a bolt action rifle including the selector arrangement of the present invention.
Figure 2:
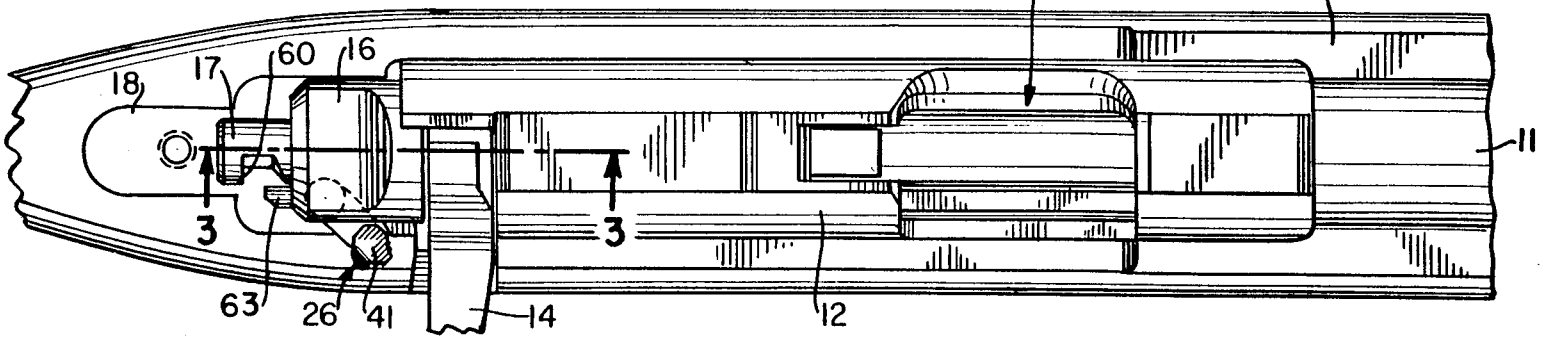
FIG. 2 is a partial plan view of such rifle.

Referring to FIGS. 1 and 2, rifle 10 includes barrel 11, a receiver 12 secured to the rear of the barrel, a cylindrical breech bolt assembly 13 mounted in receiver 12 to the rear of and in axial alignment with barrel 11, a bolt handle 14 secured to the rearward end of the bolt assembly 13, a bolt head sleeve 16, a cocking piece 17, a receiver tang 18 and a stock 21. Rifle 10 also includes trigger 22, trigger guard 23, and a rotatable inactivating selector unit 26. Unit 26 is mounted in the receiver and rotates about a vertical axis.

Figure 3:
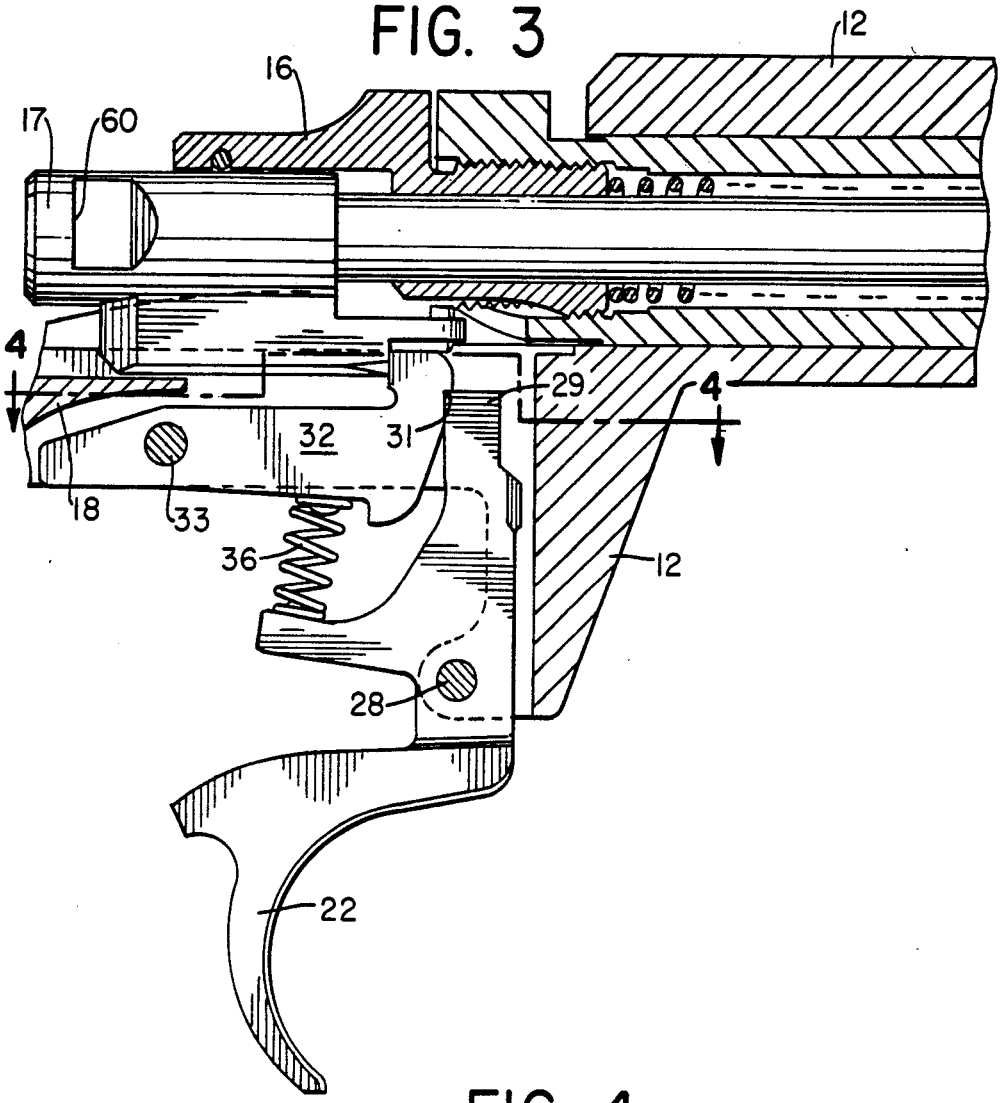
FIG. 3 is a sectional view along lines 3—3 of FIG. 2.

Turning to FIG. 3, trigger 22 is pivoted about trigger pivot 28 with upper trigger arm 29 engaged in sear notch 31 of sear 32. Sear 32 is mounted about pivot 33 and spring 36 is interposed between trigger 22 and sear 32. The pulling of trigger 22 to rotate it clockwise about pivot 28 causes trigger arm 29 to move out of sear notch 31 permitting sear 32 to rotate clockwise about pivot 33 thus releasing cocking piece 17. Cocking piece 17 then moves forward under the force of a spring (not shown)

to strike the rim of the cartridge (not shown) to fire the rifle.

Figure 4:
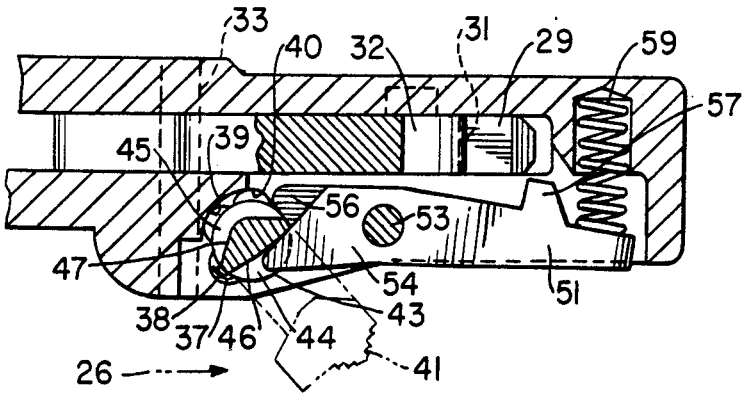
FIG. 4 is a sectional view along lines 4—4 of FIG. 3 with selector projection or thumb piece shown in phantom.
Figure 5:
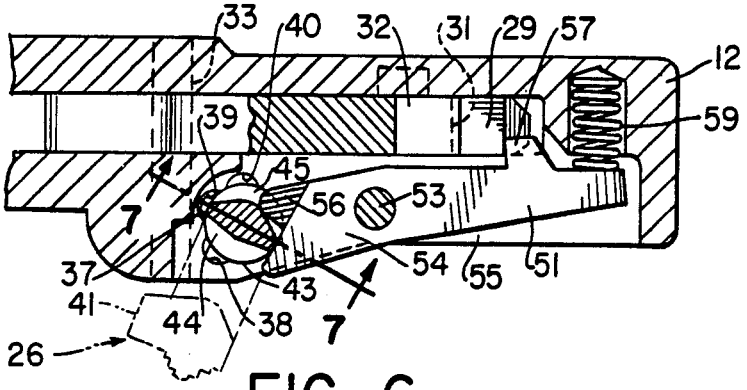
FIG. 5 is a view similar to FIG. 4 showing the selector in a position to activate trigger control lever to block the trigger and sear.
Figure 6:
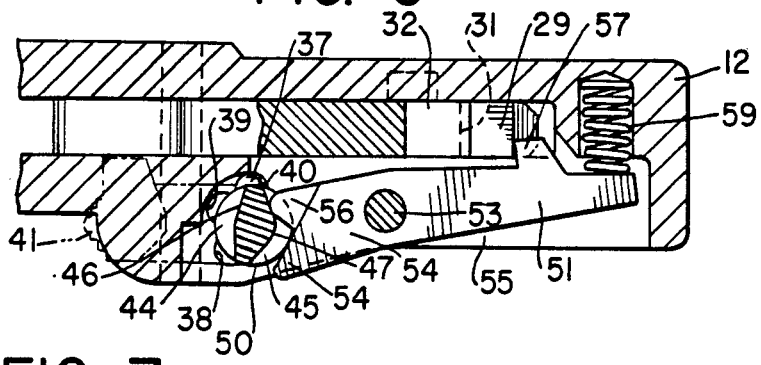
FIG. 6 is a view similar to FIG. 4 showing the selector in a position to block the trigger, sear and cocking piece.
Figure 7:
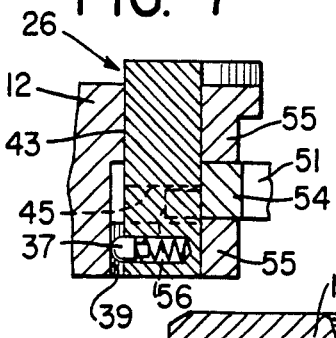
FIG. 7 is a sectional view taken along line 7—7 of FIG. 5.

With reference to FIGS. 4–8, it is seen that selector unit 26 is rotatably mounted to be turned to and held in three discrete positions determined by detent 37 (see FIG. 7) located in one (1) of the three (3) detent recesses 38, 39 and 40 (FIGS. 4–7). Selector unit 26 includes cylindrical body 43 carrying detent 37 in its lower portion (FIG. 7) and two slotted areas 44, 45 in the central part of body 43 define respectively first selector cam surface 46 and second selector cam surface 47. Selector unit 26 also includes a thumb piece 41. Slot area 44 has a thickness greater than cam follower 54 to accommodate follower 54 therein (FIG. 4). Slot area 45 is less thick than slot area 44 so that in the FIG. 6 position cam follower 54 cannot enter slot area 45 but instead rides on cylindrical surface 50 of selector body 43. Turning to FIG. 7, it is seen that cam follower 54 housed between frame elements 55, has a thickness greater than slot area 45.

On the other hand, cam follower 56 with less thickness than follower 54 is accommodated in slot area 45 throughout the rotational operation of selector unit 26.

Trigger control lever 51 is pivotable about pivot 53. On one end lever 51 carries upper cam follower 54 and lower cam follower 56 while on the opposite end trigger blocking finger 57 is located. Lever 51 is urged away from trigger 29 by spring 59.

Figure 8:
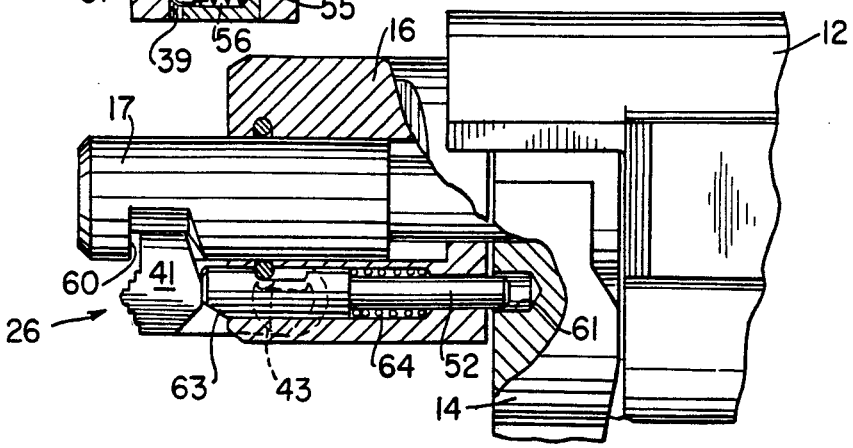
FIG. 8 is a fragmented plan view showing the selector in the position of FIG. 6 and further showing blocking plunger blocking the bolt handle.
Figure 9:
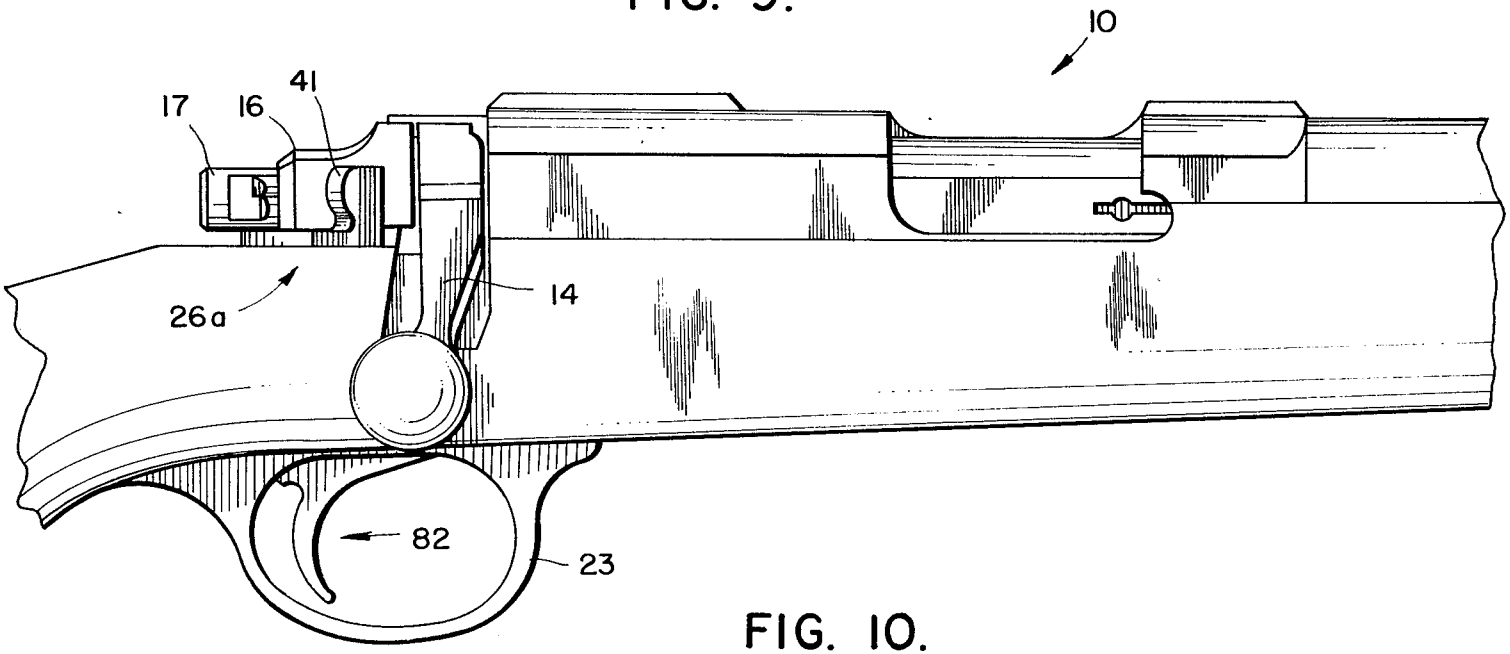
FIG. 9 is a partial side elevational view of a bolt action rifle including an alternative selector arrangement of the present invention.
Figure 10:
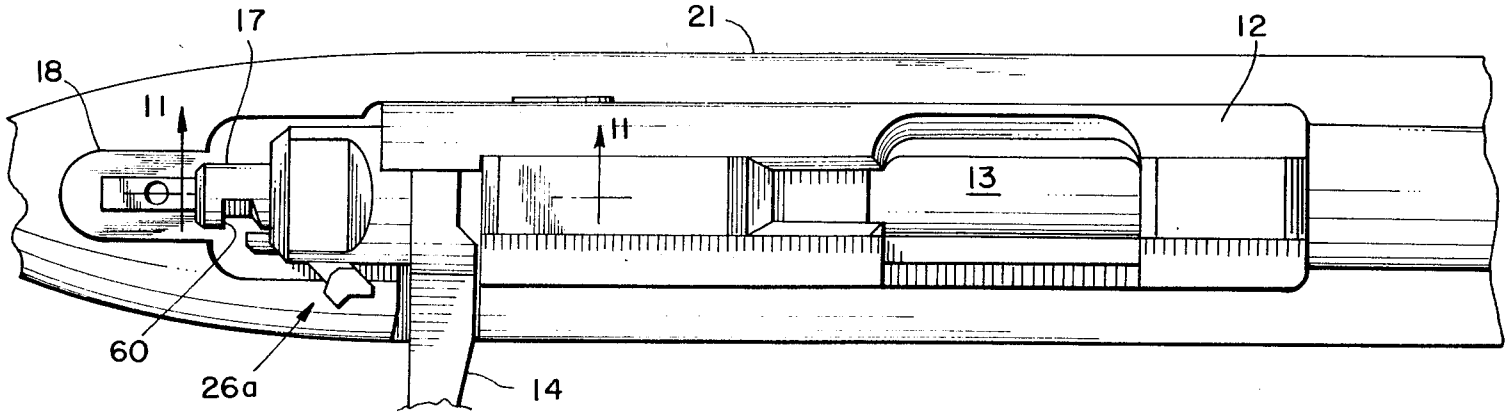
FIG. 10 is a partial plan view of the rifle of FIG. 9.
Figure 11:
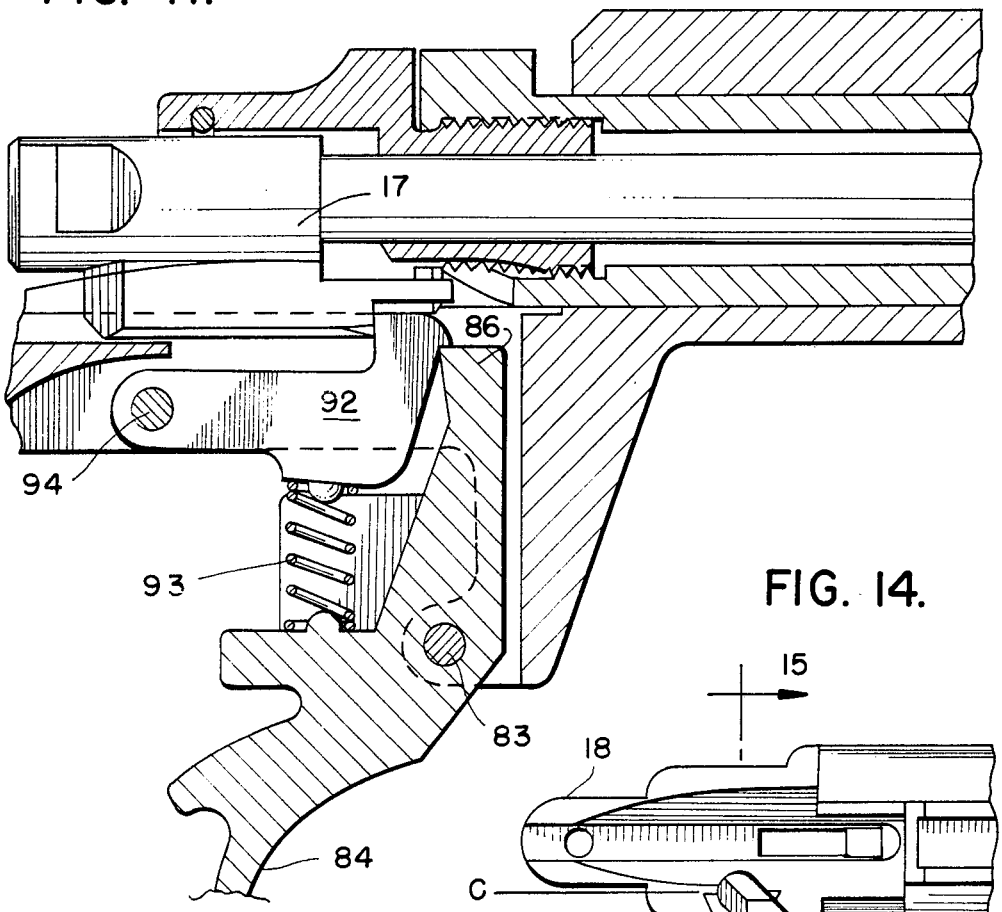
FIG. 11 is an enlarged sectional view along line 11—11 of FIG. 10.

Turning attention to FIG. 8, it is seen that cocking piece 17 has a blocking notch 60 in it for receiving offset thumb piece 41 when selector unit 26 is rotated to the position shown in FIGS. 6 and 8. In this selector position, blocking plunger 52 is urged by selector 26 into bolt handle recess 61 to block movement of the bolt handle 14. Upon release of plunger 52 by selector 26 spring 64 withdraws plunger 52 freeing handle 14.

Summarizing, selector unit 26 engages and moves trigger control lever 51 to block the trigger and it in turn the sear (see FIGS. 4–6). Unit 26 also serves to restrict movement of cocking piece 17 (see FIGS. 2 and 8) and actuates blocking plunger 52 to block movement of bolt handle 14 (FIG. 8).

In step-by-step operation selector unit 26 is turned through thumb piece 41 to a passive or neutral position causing detent 37 to snap into a detent recess 38 which places cylindrical body 43 with cam surfaces 46 and 47 in such position that finger 57 of lever 51 does not block trigger 29 (see FIG. 4). The firearm can be fired in this selector mode. To restrict trigger movement and in turn sear movement, the selector unit 26 is moved to inactivating position number one where detent 37 is moved into recess 39 causing surface 46 to move cam follower 54 of lever 51 placing lever finger 57 against trigger arm 29 (see FIG. 5). In this position, trigger arm 29 is inactivated by being restrained from rotating clockwise about pivot 28 (as shown in FIG. 3). The trigger 22 cannot rotate and the sear cannot drop to fire the rifle. Alternatively, lever 51 and its finger 57 may be designed to block rotational movement of sear 32.

Finally, selector unit 26 is movable to inactivating position number two during which movement cylindrical surface 50 moves cam follower 54 to retain lever 51 in its trigger-sear-restraining position. As thumb piece 41 is moved to bring selector unit 26 to this third position thumb piece 41 bears against beveled surface 63 causing blocking plunger 52 to move to the right into recess 61 to block rotational movement of handle 14. Spring 64 is compressed during this movement. Upon the selector reaching this third position, thumb piece 41 is in blocking notch 60 of pin striker 17 (cocking piece) to limit forward travel of striker 17 (see FIGS. 6 and 8).

It will be noted that in operation slot area 45, cam surface 47 and cam follower 56 operate to move lever 51 to the passive or neutral position of FIG. 4 while slot area 44, cam surface 46, cylindrical surface 50 and cam follower 54 operate to move lever 51 into its blocking position and hold it there when selector 26 is in positions number one and two as described above.

Figure 16:
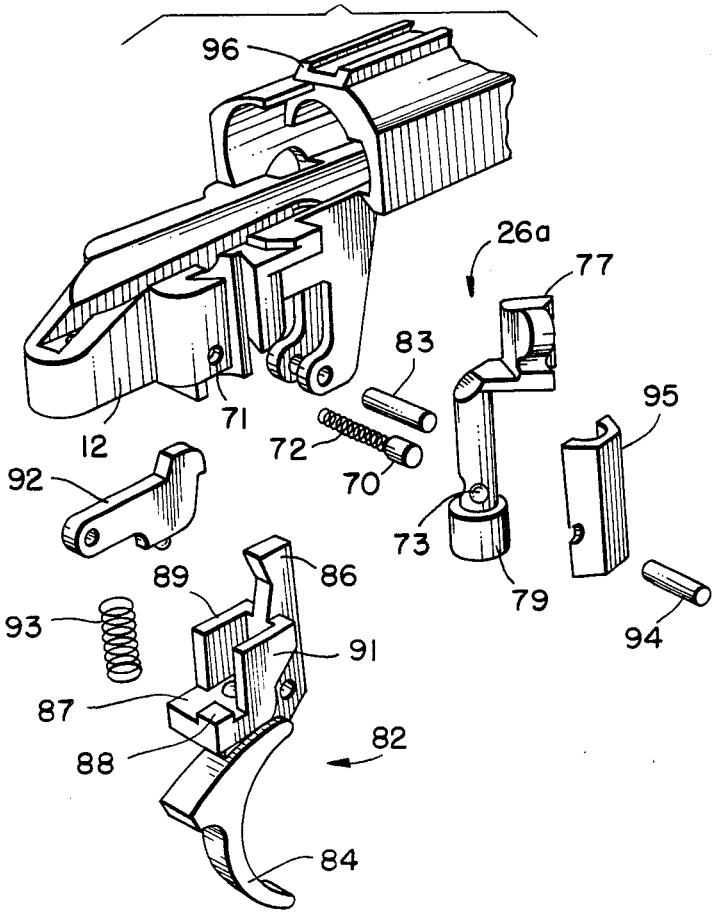
FIG. 16 is an exploded view of the receiver, selector unit, trigger, and associated parts of the alternative embodiment.
Figure 17:
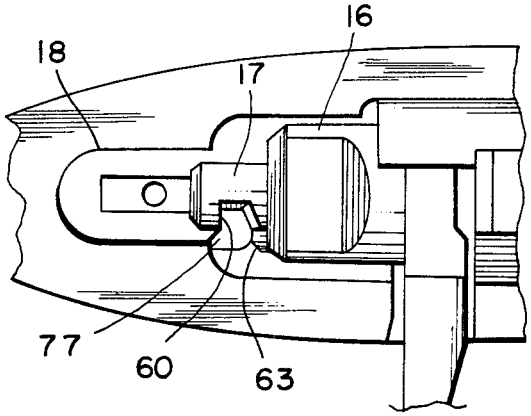
FIG. 17 is a partial elevational view showing the alternative selector unit in the bolt handle restraining position.
Figure 18:
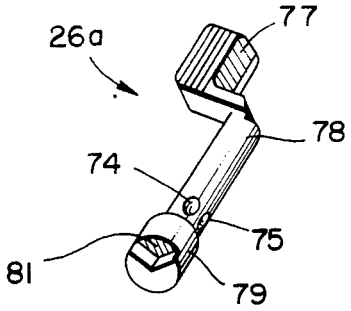
FIG. 18 is a perspective view of the alternative selector unit.

With reference to the alternative embodiment shown in FIGS. 9–18 and, in particular, with reference first to FIGS. 16 and 18, it is seen that selector unit **26*a* (like selector 26) is rotatably mounted to be turned to and held in three discrete positions determined by detent 70 mounted in a detent hole 71 in receiver 12. Detent spring 72 urges detent 70 into recesses 73, 74 and 75 in selector unit 26*a*. Selector unit 26*a* includes thumb piece 77, cylindrical body portion 78 including configured foot portion 79. Foot portion 79 carries notch 81 providing a configuration for engagement and disengagement with the trigger which will be explained. Trigger 82, pivotable about pivot axis 83, includes finger piece 84, sear-engaging upper trigger arm 86 and trigger extension 87 including extension block 88. Also shown in FIGS. 16 and 18 are trigger side pieces 89, 91; sear 92; sear spring 93; sear pin 94; selector cover plate 95; and rifle sight 96**.

Figure 14:
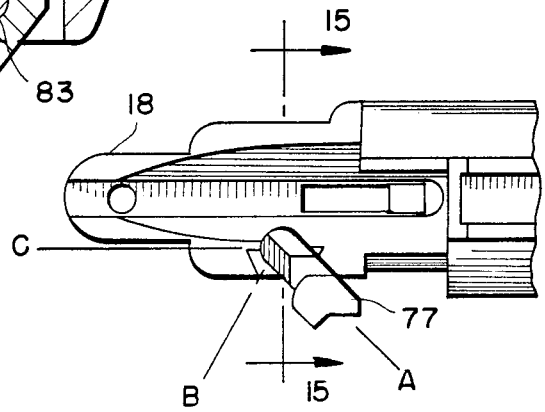
FIG. 14 is a partial elevational view showing the alternative selector arm in the forward fire position.
Figure 12:
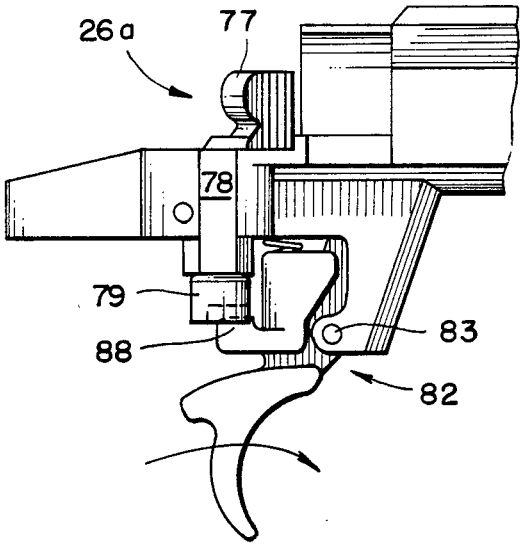
FIG. 12 is a partial side elevational view of the alternative selector arrangement and trigger unit with the selector arrangement in the fire position.
Figure 13:
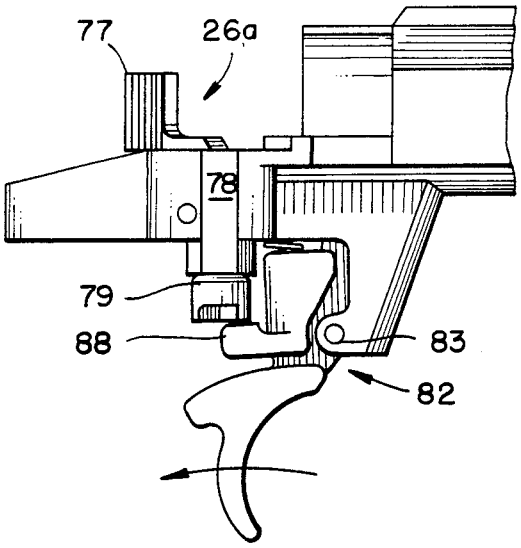
FIG. 13 is a partial side elevational view of the alternative selector arrangement in a lock position.
Figure 15:
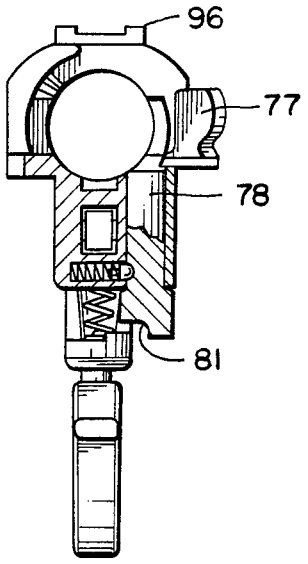
FIG. 15 is a sectional view along line 15—15 of FIG. 14.

Turning to FIGS. 12, 13, and 14, it is seen that when selector unit **26*a* is in position A (FIGS. 12 and 14), configured foot portion 79 of selector 26*a* is positioned to accommodate extension block 88 thus permitting clockwise pivoting of trigger 82, the release of sear 92 and firing of the rifle (FIG. 12). As the selector thumb piece 77 is moved back from position A to points where rectangular block 88 is no longer able to be accommodated in notch 81 (such as position B in FIG. 14), a portion of foot portion 79 moves adjacent block 88 (with minimal clearance) to prevent, in these positions, any significant rotation of trigger 82. Trigger 82 cannot in these positions be rotated clockwise to release sear 92** to fire the rifle.

Turning now to FIG. 17, the selector has been moved further rearward to place it in cocking piece notch 60. Movement of selector **26*a* to position C of FIG. 14 to lock bolt handle 14 is the same as operation of selector 26** described above.

We claim:

1. In a bolt action firearm having a barrel, a receiver, a bolt sleeve, a cocking piece, a bolt handle, a trigger and a sear, the improvement comprising a multi-positional selector-operated arrangement capable of restraining movement of the trigger and associated sear in a first position and restraining movement of trigger, sear and bolt handle in a second position, such arrangement in turn comprising:

(a) trigger and sear blocking means for preventing rotation of the trigger in a direction to release the sear;

(b) a rotatable selector means positioned in the receiver for rotating about a vertical axis which selector means is rotatable to selected positions, such selector means having (1) a body portion, and (2) a hand-engageable projection portion;

(c) actuation means for actuating said trigger and sear blocking means when said selector is turned to the first or to the second positions;

(d) a notch in the cocking piece;

(e) a recess in the bolt handle; and (f) a blocking plunger means positioned to be moved into the recess in the bolt handle as the selector means is moved to such second position carrying said hand-engageable projection portion into said notch.

2. The selector arrangement of claim 1 in which the trigger blocking means in turn comprises:

(a) cam means on the selector body portion; and (b) elongated pivotable trigger and sear restraining means having on one end a cam follower surface which engages said cam means on such body portion and such restraining means having on the other end trigger engaging means whereby the rotation of the selector means to the two positions actuates the elongated pivotable trigger and sear restraining means to restrain trigger movement in the first position and to allow trigger movement in the second position.

3. The selector arrangement of claim 1 in which the trigger blocking means in turn comprises extension means mounted on the trigger for rotation therewith; and in which the actuation means comprises foot means on the rotatable selector means whereby as the selector means is rotated the extension means and foot means are engaged in said first position to restrain trigger rotation and whereby the selector means is rotated to a third position in which extension means and foot means are not engaged in said third position to permit trigger rotation to release the sear.

4. The arrangement of claim 1 in which the selector means is movable to a third position in which the trigger is blocked and the bolt handle is not blocked.

5. The arrangement of claim 2 in which the selector means is movable to a third position in which the trigger is blocked and the bolt handle is not blocked.

6. The arrangement of claim 3 in which the selector means is movable to a third position in which the trigger is blocked and the bolt handle is not blocked.

7. In a bolt action firearm having a barrel, a receiver, a bolt sleeve and a cocking piece, a bolt handle, a trigger and a sear, the improvement comprising a multi-positional selector-operated arrangement capable of restraining movement of the trigger and associated sear in a first position and restraining movement of trigger, sear and bolt handle in a second position, such arrangement in turn comprising:

(a) trigger and sear blocking means for preventing rotation of the trigger in a direction to release the sear; said blocking means including an extension on the trigger;

(b) a rotatable selector means positioned in the receiver for rotating about a vertical axis which selector means is rotatable to selected positions, such selector means having (1) a body portion including a configured foot portion and (2) a hand-engageable projecton portion;

(c) actuation means for actuating said trigger and sear blocking means when said selector is turned to the first or to the second position; said actuation means including said foot portion of the selector body means;

(d) a notch in the cocking piece;

(e) a recess in the bolt handle; and (f) a blocking plunger means positioned to be moved into the recess in the bolt handle as the selector means is moved to such second position and said hand-engageable projection portion is moved into said notch whereby as the selector means is rotated (1) the configured foot portion engages and disengages from the trigger extension to block and unblock trigger rotation and (2) to engage, hold and release the cocking piece.

* * * * *